US012624565B2

(12) United States Patent
Collyard

(10) Patent No.: US 12,624,565 B2
(45) Date of Patent: May 12, 2026

(54) TRUCK BED CANOPY DEVICE

(71) Applicant: Jeremy Scott Collyard, Arvada, CO (US)

(72) Inventor: Jeremy Scott Collyard, Arvada, CO (US)

( * ) Notice: Subject to any disclaimer, the term of this patent is extended or adjusted under 35 U.S.C. 154(b) by 281 days.

(21) Appl. No.: 18/508,543

(22) Filed: Nov. 14, 2023

(65) Prior Publication Data

US 2025/0154789 A1 May 15, 2025

(51) Int. Cl.
*E04H 15/06* (2006.01)
*E04H 15/44* (2006.01)

(52) U.S. Cl.
CPC ..... *E04H 15/06* (2013.01); *E04H 15/44* (2013.01)

(58) Field of Classification Search
CPC ..... E04H 15/06
See application file for complete search history.

(56) References Cited

U.S. PATENT DOCUMENTS 3,929,147 A * 12/1975 Roscoe ..... E04H 15/06 135/88.07
4,310,194 A * 1/1982 Biller ..... B60P 3/32 296/26.02
4,519,409 A * 5/1985 Kinney ..... E04H 15/06 135/88.08
5,066,063 A * 11/1991 Mullally ..... B60J 7/104 296/108
5,660,425 A * 8/1997 Weber ..... E04H 15/06 135/88.13
5,951,095 A 9/1999 Herndon
5,988,195 A * 11/1999 Kaestner ..... E04H 15/06 135/88.13
6,030,026 A * 2/2000 Vega ..... B60P 3/341 135/88.13
6,202,664 B1 * 3/2001 Shenton, Jr. ..... E04H 15/06 135/90
6,209,944 B1 4/2001 Billiu et al.
6,394,118 B1 * 5/2002 Cikanowick ..... E04H 15/06 135/88.13
6,725,807 B1 * 4/2004 Tapia ..... A01K 1/0272 119/482

(Continued)

OTHER PUBLICATIONS

Amazon.com "Command Post Tailgate Canopy—Bumperchute (2 fer XL/L, Black/White)" printed from the Internet Dec. 7, 2021.

(Continued)

*Primary Examiner* — Noah Chandler Hawk
(74) *Attorney, Agent, or Firm* — Trenner Law Firm, LLC; Mark Trenner

(57) ABSTRACT

A truck bed canopy device is disclosed as it may include post members installed in a bed of a truck or other vehicle. The example truck bed canopy device also includes rafter members connected to the post members. The example truck bed canopy device also includes drop members extending between the post members and the rafter members. The example truck bed canopy device also includes a ridge member and a cross member each extending between the rafter members. The example truck bed canopy device also includes a canopy connected on one end to the cross member, extending over the ridge member, and connected to the truck. The truck bed canopy device can be readily deployed and taken down for stowage.

2 Claims, 7 Drawing Sheets

(56) References Cited

U.S. PATENT DOCUMENTS

| | | | | |
|---|---|---|---|---|
| 6,749,252 | B2 | 6/2004 | Cervenka | |
| 7,021,694 | B1 * | 4/2006 | Roberts | B60P 3/341 5/118 |
| 7,775,229 | B2 * | 8/2010 | Sy-Facunda | E04H 15/50 135/117 |
| 8,182,020 | B2 | 5/2012 | Herndon | |
| 9,834,076 | B2 | 12/2017 | Rohr et al. | |
| 11,795,727 | B2 * | 10/2023 | Moller | E04H 15/06 |
| 2009/0051185 | A1 * | 2/2009 | Lotz | B60J 7/1621 296/37.6 |
| 2011/0226297 | A1 * | 9/2011 | Rewis | E04H 15/06 248/220.21 |
| 2016/0251872 | A1 * | 9/2016 | Tucker | E04H 15/08 135/88.01 |

OTHER PUBLICATIONS

Amazon.com "Sportz Truck Tent Blue/Grey (Full Size Short 6.5-Feet Box)" printed from the Internet Dec. 7, 2021.
QVC.com "Rightline Gear Truck Tailgating Canopy" H243945 printed from the Internet Dec. 7, 2021.

* cited by examiner

TRUCK BED CANOPY DEVICE

BACKGROUND

The open bed of a truck is convenient for hauling cargo, but is left exposed to the elements, such as direct sunshine, rain, snow, and hail. There are shade structures that can be deployed on the ground and placed near the truck to protect people and/or equipment from the weather conditions. These shade structures typically cannot be deployed on the truck bed, and even if the user sets up the shade structure in the back of or over the truck bed, the shade structure must be taken down before the truck can be driven.

The open bed of a truck is designed for hauling cargo and is convenient for other uses such as performing work (contractors, environmental sampling, etc.) and for recreation (tailgating, camping, etc.). However, truck beds are exposed to the elements, such as direct sunshine, rain, snow and hail.

There are shade structures that can be deployed on the group and placed near the truck to protect people and/or equipment from weather conditions. These shade structures typically cannot be deployed on the truck bed and for the limited products that do incorporate the truck bed into the structure, the shade structure still relies on ground placement. Therefore, these must be taken down before moving the truck.

DETAILED DESCRIPTION

A truck bed canopy device is disclosed as it may be installed on a truck bed (e.g., a pickup truck) for numerous purposes, including but not limited to, commercial, recreational, and personal use. In an example, the truck bed canopy device is readily deployable, and can remain up or be taken down and stowed for travel.

The truck bed canopy device is designed to be deployed on the vehicle to allow for mobility of the vehicle while the device is deployed and servicing its purpose, but also for ease of set up and take down and for structural stability.

The truck bed canopy device is collapsible, and is compact when stored so that it fits within the cab or can be stowed on the tailgate of the pickup truck. When deployed, the canopy covers all or part of the bed of the truck. The canopy also extends to cover the tailgate, and beyond the tailgate to cover an area behind the tailgate. The canopy does not inhibit closing the tailgate when deployed or stored on the tailgate. Even when deployed, the canopy does not prevent driving the truck.

The canopy does not inhibit the closing of the tailgate when deployed allow for the safe driving of the vehicle while still deployed. When not deployed, the truck bed canopy device is stored within a carrying case that fits inside the cab of the truck or within the truck bed.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described above are provided for purposes of illustration, and are not intended to be limiting. Other devices and/or device configurations may be utilized to carry out the operations described herein. In addition, while the invention is described as it may be utilized with a pickup truck, it is noted that the truck bed canopy may also be used with other vehicles (including but not limited to other types of trucks and even trailers).

The operations shown and described herein are provided to illustrate example implementations. It is noted that the operations are not limited to the ordering shown. Still other operations may also be implemented.

Figure 1:
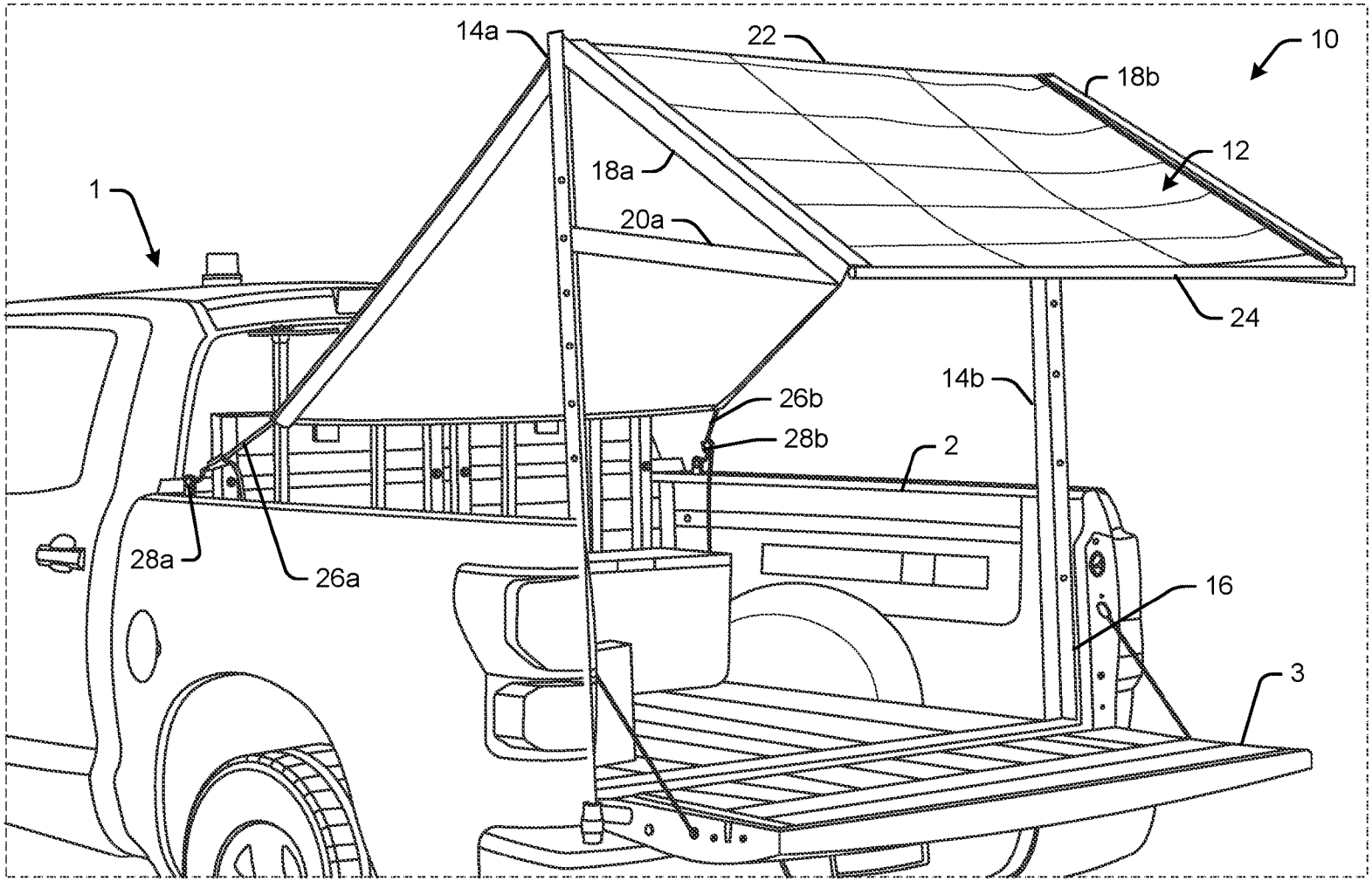
FIG. 1 is a rear perspective view of an example truck bed canopy device as it may be installed in the bed of a pickup truck.

FIG. 1 is a rear perspective view of an example truck bed canopy device 10 as it may be installed in the bed 2 of a pickup truck 1. The term "rear" is relative to the rear of the truck 1. The truck bed canopy device 10 can be quickly deployed to cover some or all of the bed 2 of the truck 1, some or all of the tailgate 3 of the truck, and/or extend beyond the tailgate 3 to cover behind the rear of the truck 1.

Figure 2:
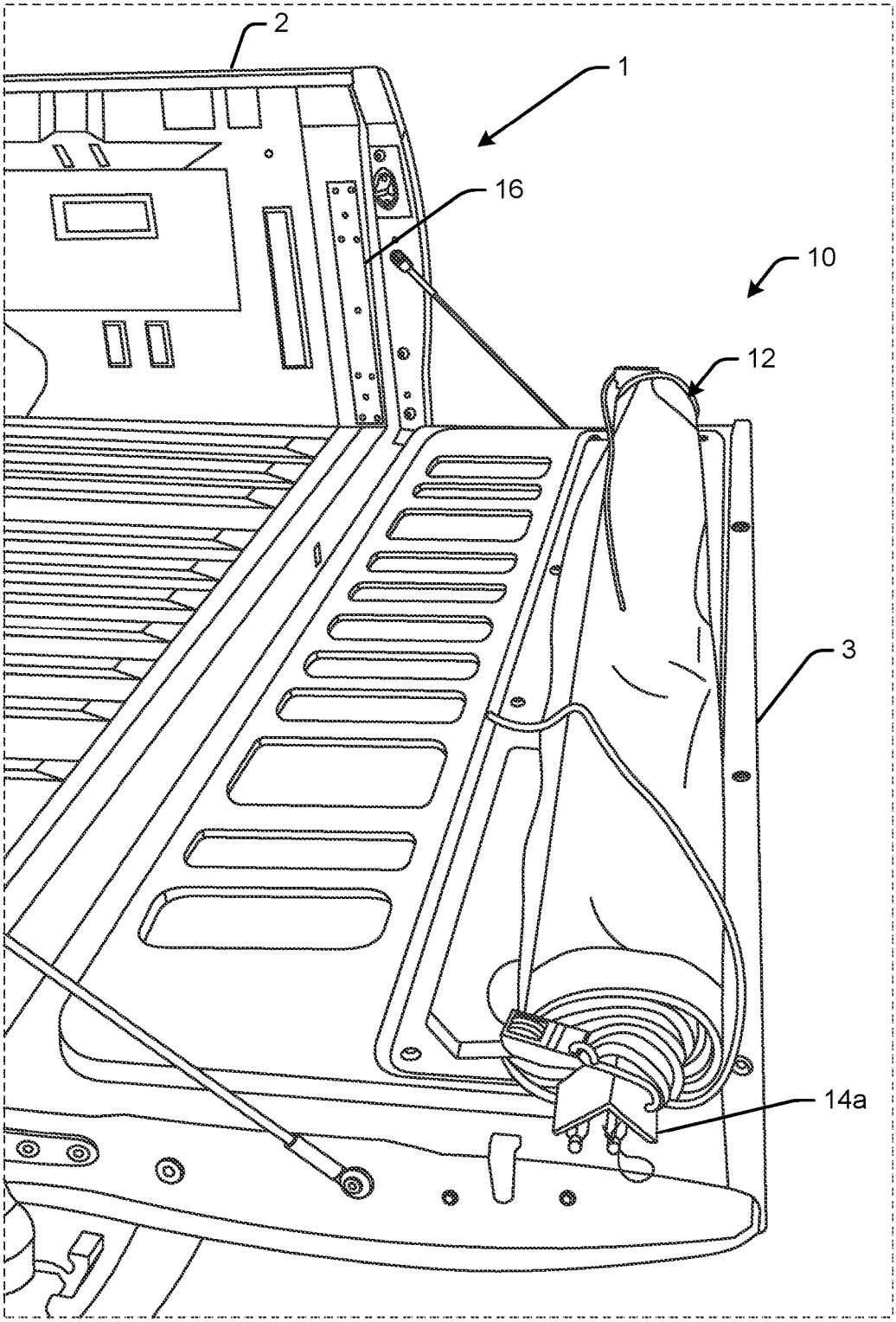
FIG. 2 is a perspective view showing the example truck bed canopy device corresponding to FIG. 1, as it may be rolled up in a closed configuration on the tailgate of the pickup truck.

In an example, the truck bed canopy device 10 does not need to be taken down to drive the truck. For example, the truck bed canopy device 10 may remain in a deployed state for driving. Or for example, the canopy 12 can be taken off and the remaining structure may stay in a deployed state for driving. The truck bed canopy device 10 may also be quickly unassembled and stored (e.g., in the bed 2 of the truck, in the cab, in a trailer, etc.). In an example, the truck bed canopy device 10 may even be stored on the tailgate of the truck, as seen for example, in FIG. 2. FIG. 2 is a perspective view showing the example truck bed canopy device corresponding to FIG. 1, as it may be rolled up in a closed configuration on the tailgate 3 of the truck 1.

An example of the truck bed canopy device 10 includes post members 14*a*, 14*b*. In an example, the post members 14*a*, 14*b* have a substantially square or rectangular cross section. The post members 14*a*, 14*b* can be installed in a vertical orientation in the bed 2 of the truck 1. For example, the post members 14*a*, 14*b* may be attached to two plates 16 mounted to the inside wall of the truck bed 2.

The example truck bed canopy device 10 also includes rafter members 18*a*, 18*b* each separately connected on a first end to a top portion of each of the post members 14*a*, 14*b*. In an example, the rafter members 18*a*, 18*b* have a substantially U-shaped cross section.

Drop members 20*a*, 20*b* extend between each of the post members 14*a*, 14*b* and a second end of each of the rafter members 18*a*, 18*b*. In an example, the drop members 20*a*, 20*b* are hinged to the respective rafter members 18*a*, 18*b*. The drop members 20*a*, 20*b* are configured to be connected to any of a plurality of positions on the respective post members 14*a*, 14*b* to adjust a height of the cross member 24 and the drip edge.

A ridge member 22 extends between the top portions of the rafter members 18*a*, 18*b*. A cross member 24 extends between the second end of the rafter members 18*a*, 18*b* to form a drip edge. In an example, the ridge member 22 and the cross member 24 are each sized to be approximately the width (e.g., the interior width) of the bed 2 of the truck 1. In an example, the ridge member 22 and the cross member 24 have a circular cross section.

In an example, a first opening is formed in the first end of each of the rafter members 18*a*, 18*b*. The first opening is configured to receive the ridge member 22. A second opening is formed in the second end of each of the rafter members 18*a*, 18*b*. The second opening is configured to receive the cross member 24.

After assembling the structure of the example of the truck bed canopy device 10, the canopy is connected on the first end to the cross member 24. The canopy extends over the ridge member and connects to the truck in the deployed state.

In an example, at least one loop is provided (e.g., sewn) in a first end of the canopy 12. The cross member 24 is received through the loop(s). At least one attachment line 26*a*, 26*b* on a second end of the canopy 12 connects the canopy 12 to the truck 1. In an example, a hook 28*a*, 28*b* on the attachment line(s) 26*a*, 26*b* connect the canopy 12 to the truck 1 and adjust tension in the attachment line(s) 26*a*, 26*b*. An adjustment member (e.g., a turnbuckle or "come-along") on the attachment line(s) 26*a*, 26*b* may be provided to adjust tension in the canopy. In another example, the attachment line(s) 26*a*, 26*b* may be made of bungee cord.

Figure 3:
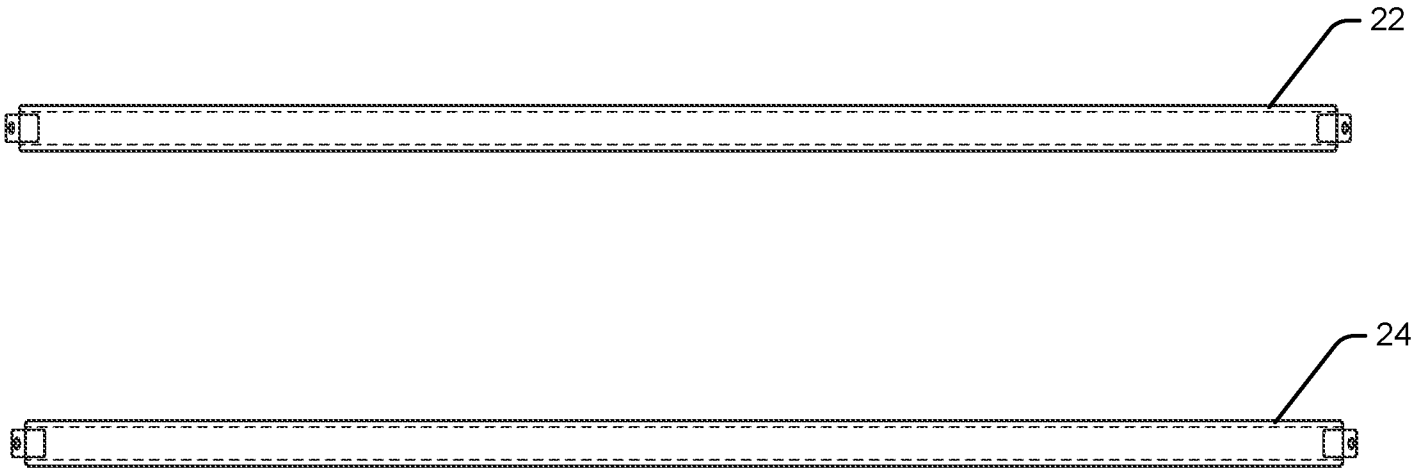
FIGS. 3-5 are component views of the example truck bed canopy device corresponding to FIG. 1.
Figure 4:
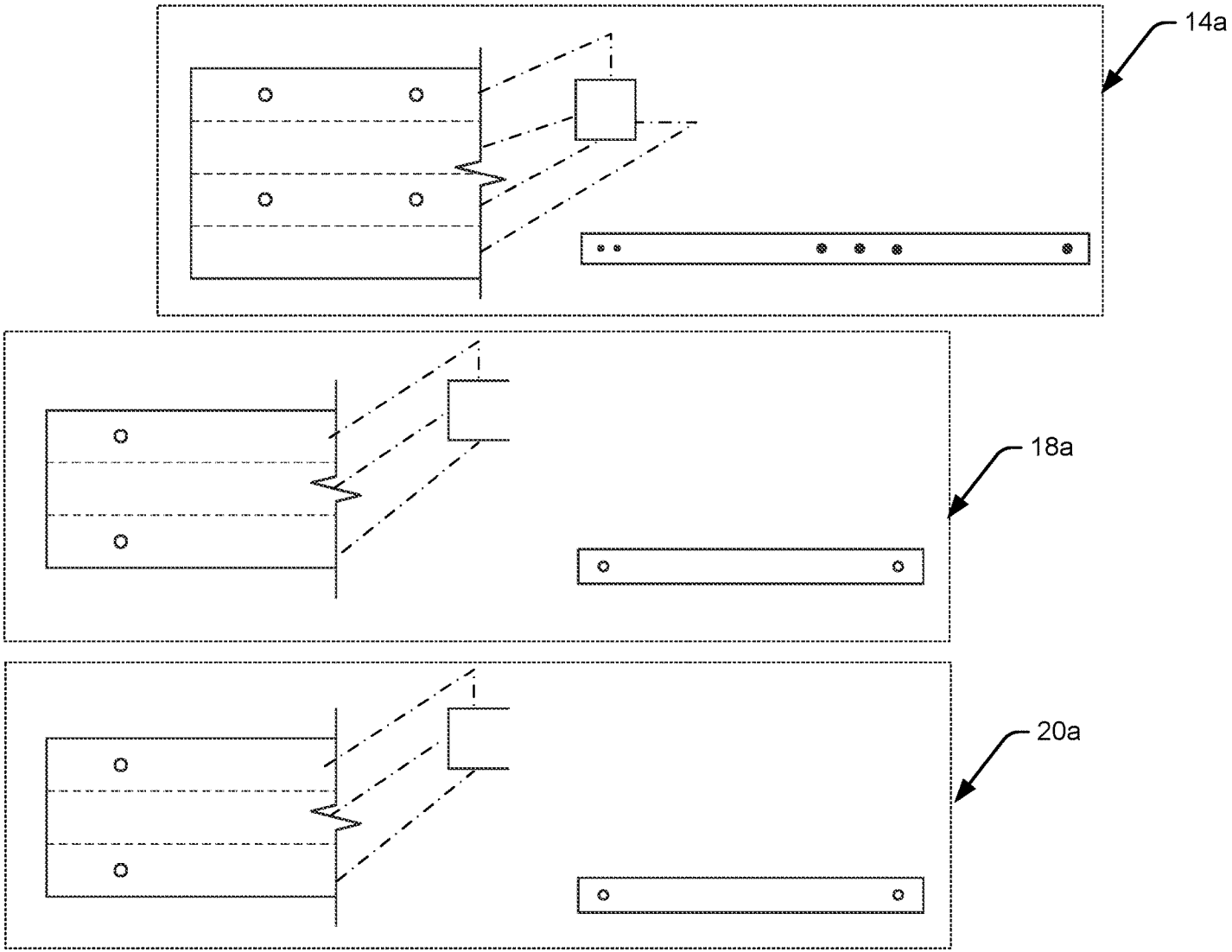
Figure 5:
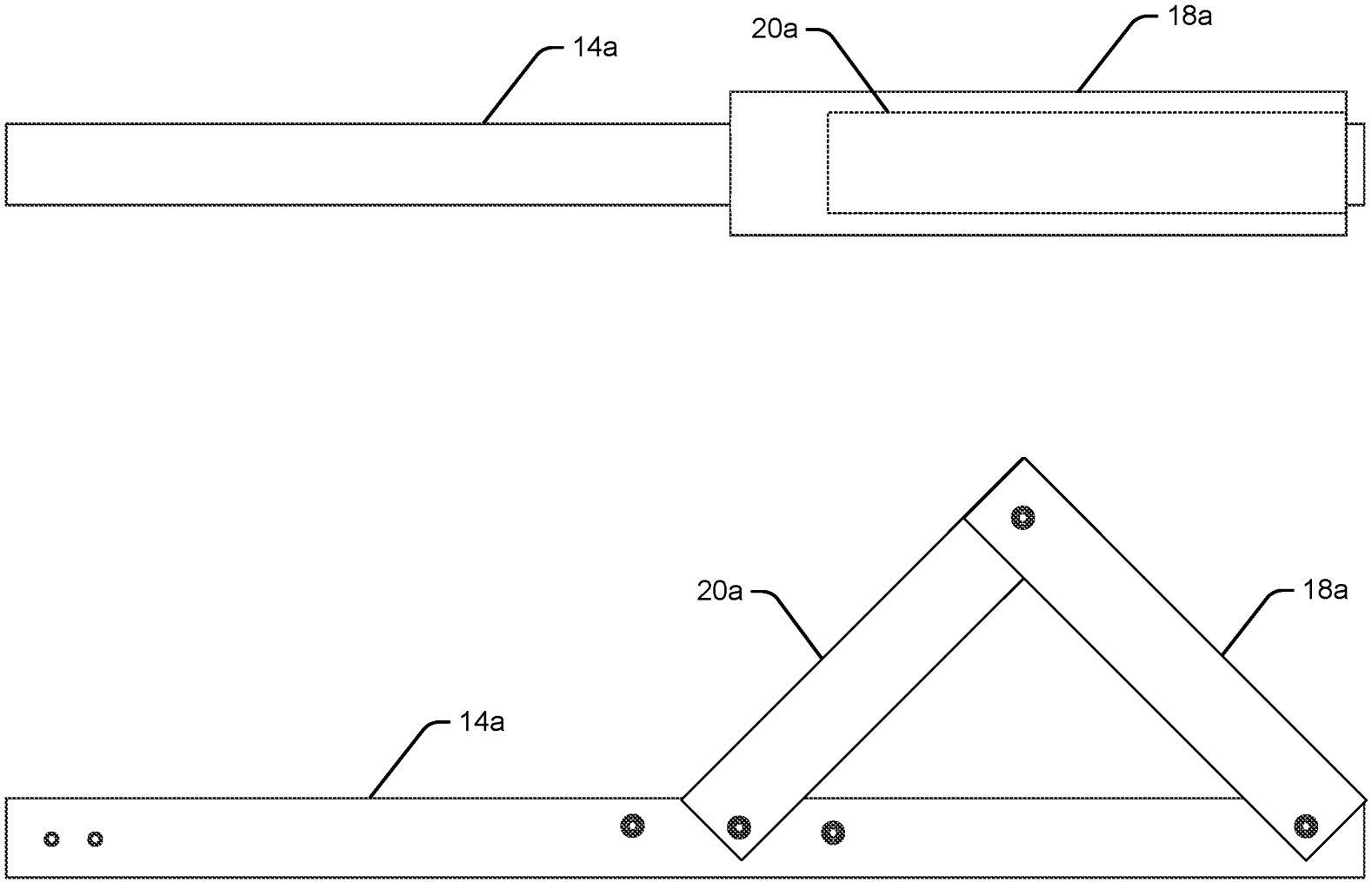

FIGS. 3-5 are component views of the example truck bed canopy device 10 corresponding to FIG. 1. An example truck bed canopy device 10 includes a first post member 14*a* and a second post member 14*b* for installing in a vertical orientation in a rear portion of a truck 1. The post members 14*a*, 14*b* have a substantially square or rectangular cross section. The example truck bed canopy device 10 also includes a first rafter member 18*a* and a second rafter member 18*b*. The rafter members 18*a*, 18*b* are rotatably connected on a first end to a top portion of the respective post member 14*a*, 14*b*. The example truck bed canopy device 10 also includes a first drop member 20*a* and a second drop member 20*b*. The drop members 20*a*, 20*b* extend between the post members 14*a*, 14*b* and a second end of the respective rafter members 18*a*, 18*b*. These components form a triangle, as seen in the assembled views (e.g., see FIG. 1).

The drop members 20*a* and 20*b* may be made from 1.25 inch square tubing having one open side so that it is shaped substantially like a U. This allows these sections to be folded over post members 14*a* and 14*b* when stored, as seen in the top drawing in FIG. 5.

The rafter members 18*a* and 18*b* are also made from 1.5 inch square tubing having one open side so that it is shaped substantially like a U. Rafter members 18*a* and 18*b* are larger to fold over drop members 20*a* and 20*b*, as seen in the top drawing in FIG. 5.

The example truck bed canopy device 10 also includes a ridge member 22. The ridge member 22 extends between the top portion of the rafter members 18*a*, 18*b*, and also between the top portions of the posts 14*a*, 14*b*. Ridge member 22 has a substantially circular cross section. The example truck bed canopy device also includes a cross member 24 with a substantially circular cross section. Cross member 24 extends between the second end of the rafter members 18*a*, 18*b* to form a drip edge. The mounting plates 16 are also seen in FIG. 4.

Figure 6:
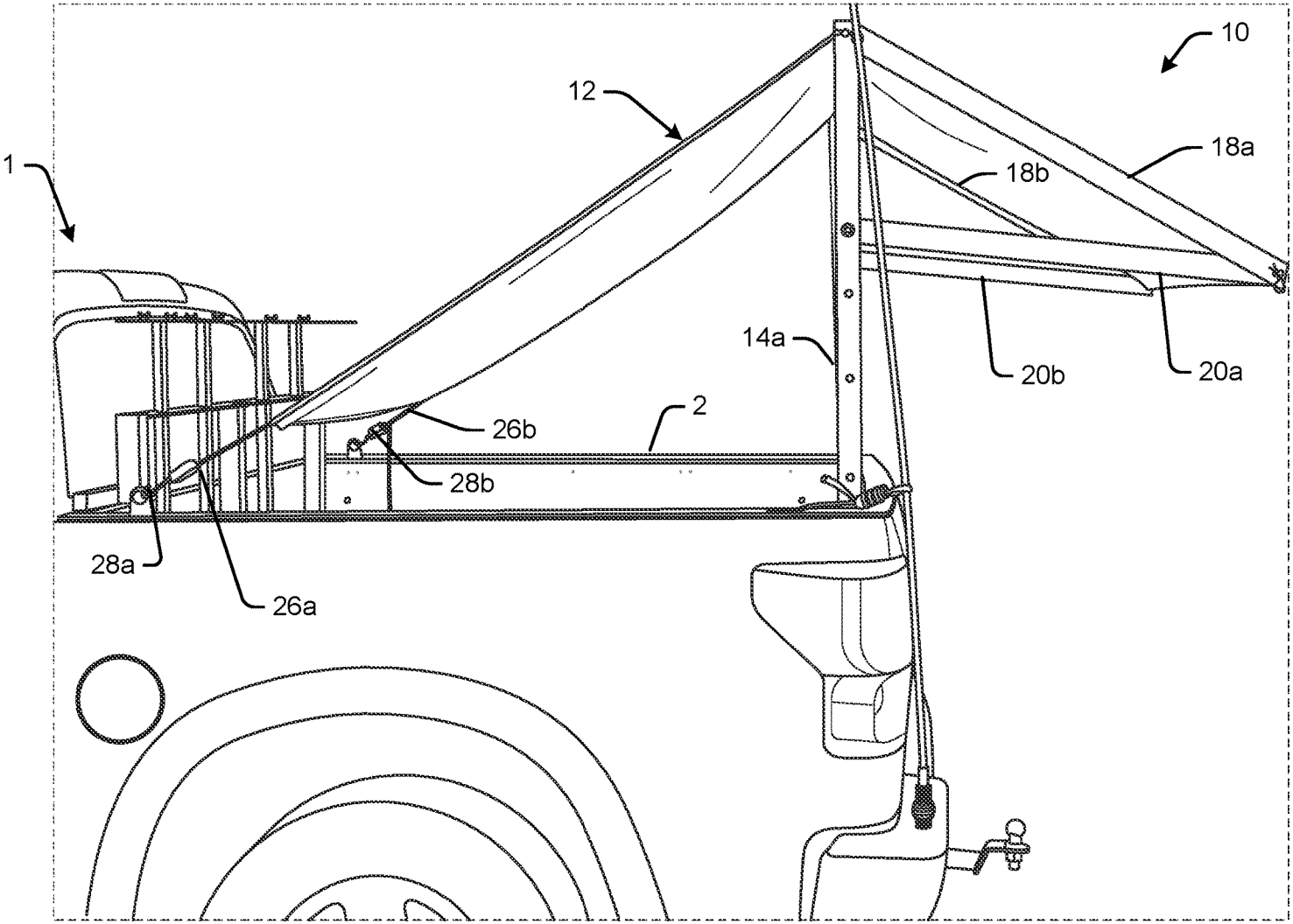
FIG. 6 is a side perspective view of the example truck bed canopy device corresponding to FIG. 1, as it may be installed in the bed of the pickup truck.
Figure 7:
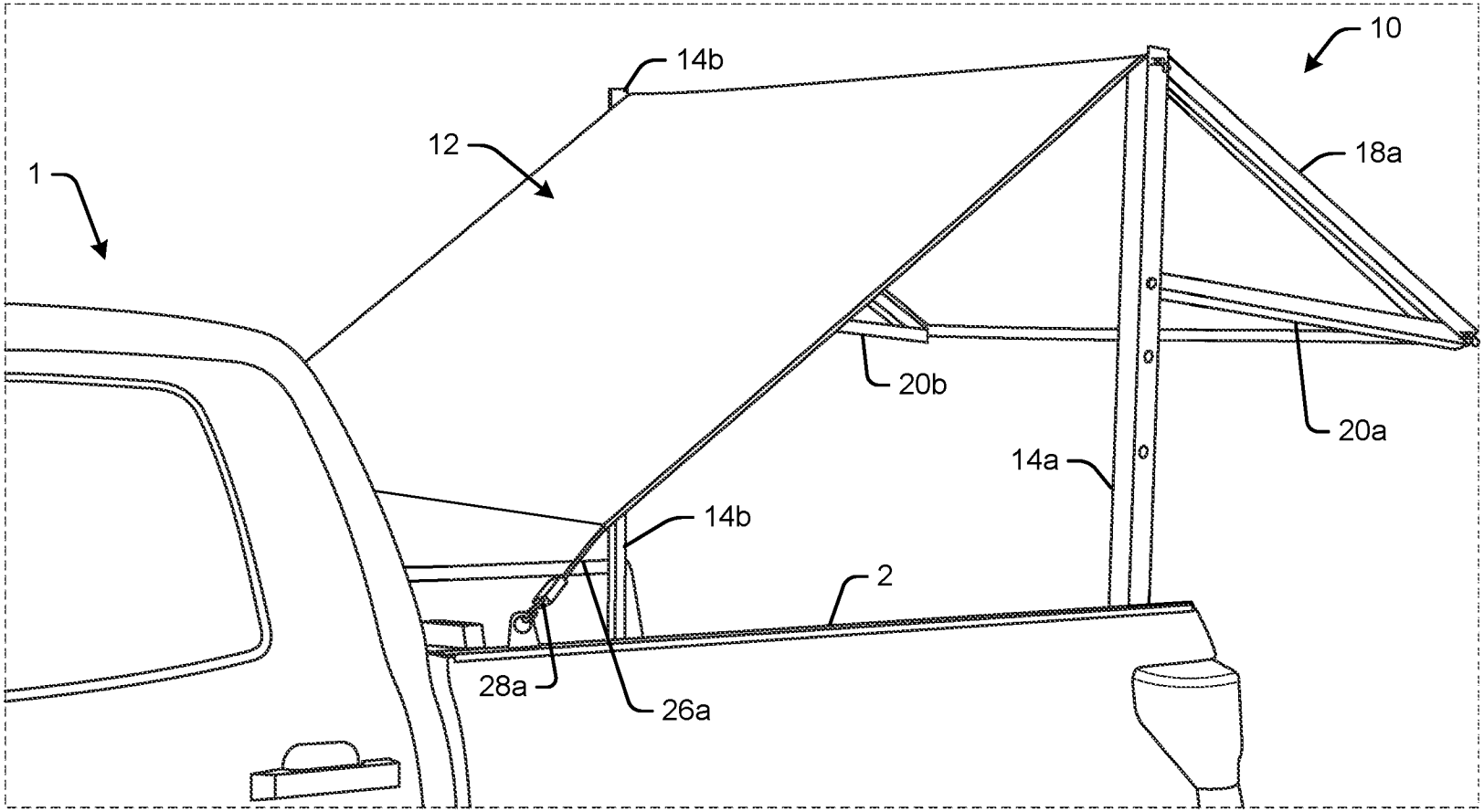
FIG. 7 is a front perspective view of an example truck bed canopy device corresponding to FIG. 1, as it may be installed in the bed of the pickup truck.

FIG. 6 is a side perspective view of the example truck bed canopy device 10 corresponding to FIG. 1, as it may be installed in the bed 2 of the truck 1. FIG. 7 is a front perspective view of an example truck bed canopy device 10 corresponding to FIG. 1, as it may be installed in the bed 2 of the truck 1.

An example method of installing the canopy device 10 in the bed 2 of a truck 1 includes Another example method includes attaching the posts 14*a*, 14*b* to the respective plates 16 mounted to each side of the inside of the truck bed 2 near the tailgate 3. Next, first and second post members 14*a*, 14*b* are installed in a vertical orientation on an inside wall of the truck bed 2. The example method also includes connecting first and second rafter members 18*a*, 18*b* to the first and second post members 14*a*, 14*b*. The example method also includes positioning first and second drop members 20*a*, 20*b* to extend between the post members 14*a*, 14*b* and the corresponding rafter members 18*a*, 18*b*.

The example method also includes positioning a ridge member 22 to extend between the first rafter member 18*a* and the second rafter member 18*b*. The example method also includes positioning a cross member 24 to extend between the first rafter member 18*a* and the second rafter member 18*b* to form a drip edge.

The example method also includes connecting the first end of a canopy 12 to the cross member 24. For example, the cross member 24 may be slid through a loop sewn along the edge of the canopy 12. The example method also includes extending the canopy 12 over the ridge member 22 and connecting a second end of the canopy 12 to the truck 1, e.g., via attachment lines 28*a*, 28*b*.

The drop bars 20*a*, 20*b* and rafter members 18*a*, 18*b* are extended out from the posts 14*a*, 14*b*, and a cross bar 24 is slid through the circular holes of the four bars and the loop of the canopy 12, creating a triangle in the frame that secures the canopy 12.

Once set up, the post members 14*a*, 14*b* may be raised to elevate the canopy 12, and then secured to the plates 16. The hooks 28*a*, 28*b* on the attachment lines 26*a*, 26*b* attach the canopy 12 to the truck 1 near the cab, and are adjusted or pulled tight to secure the entire canopy 12. Once deployed, the tailgate 3 of the truck 1 can be closed and the truck 1 can be driven without taking down the canopy 12.

In an example, the loop runs the entire width of the canopy 12 at the end. There is no loop at the top. The line that runs along the sides to secure the canopy 12 to the bed by the cab of the truck loops the circular cross bar, runs within the canopy, and exits near the cab of the truck.

To deploy the canopy, each of the posts 14*a* and 14*b* are attached to the plate using a threaded bolt with a T grip on the end to allow for hand tightening. The posts 14*a* and 14*b* are laying on the tailgate at an angle at this time. The ridge member 22 at the top that runs between the two posts 14*a* and 14*b* is attached to both posts 14*a* and 14*b*. The canopy itself is rolled out and over the top ridge member 22 and the bottom crossbar or outer crossbar (that is within the canopy 12 at all times) is attached to the outer point where 20 and 22 converge. The posts 14*a* and 14*b* are then elevated to a vertical position and secured to the plate 16 using the second bolt with a Trip on it. Finally, the line running the sides of the canopy 12, within the canopy 12, are hooked to the location near the bed of the truck, and the lines are tightened using the come along.

It is noted that the examples shown and described are provided for purposes of illustration and are not intended to be limiting. Still other examples are also contemplated.

The invention claimed is:

1. A method of installing a canopy device in a truck bed, comprising:

installing a first post member in a vertical orientation on a first side of the truck bed;

installing a second post member in a vertical orientation on a second side of the truck bed;

connecting a first rafter member to the first post member;

connecting a second rafter member to the second post member;

positioning a first drop member to extend between the first post member and the first rafter member;

positioning a second drop member to extend between the second post member and the second rafter member;

positioning a ridge member to extend between the first rafter member and the second rafter member;

positioning a cross member to extend between the first rafter member and the second rafter member to form a drip edge;

connecting a first end of a canopy to the cross member;

extending the canopy over the ridge member; and connecting a second end of the canopy to the truck.

2. The method of claim 1, further comprising first installing plates to the truck for mounting the first and second post members.

* * * * *